United States Patent [19]

Harada et al.

[11] Patent Number: 4,707,110

[45] Date of Patent: Nov. 17, 1987

[54] IMAGE FORMING APPARATUS WITH COLOR CHANGE AREA DISCRIMINATING FUNCTION

[75] Inventors: Kentaro Harada, Tokyo; Junji Watanabe, Yokohama, both of Japan

[73] Assignee: Kabushiki Kaisha Toshiba, Kawasaki, Japan

[21] Appl. No.: 944,844

[22] Filed: Dec. 22, 1986

[30] Foreign Application Priority Data

Dec. 27, 1985 [JP] Japan ..... 60-294035
Mar. 20, 1986 [JP] Japan ..... 61-63239
Mar. 20, 1986 [JP] Japan ..... 61-63240

[51] Int. Cl.[4] ..... G03G 15/00

[52] U.S. Cl. ..... 355/7; 355/4; 355/14 R

[58] Field of Search ..... 355/4, 5, 7, 14 R, 14 C, 355/14 E; 340/815.08, 815.09, 815.1, 815.12

[56] References Cited

U.S. PATENT DOCUMENTS 3,792,913 2/1974 Simmons ..... 355/7
3,972,610 8/1976 Gross ..... 355/7
4,346,982 8/1982 Nakajima et al. ..... 355/7 X
4,632,538 12/1986 Lemelson et al. ..... 355/14 R
4,653,899 3/1987 Watanabe ..... 355/14 R

*Primary Examiner*—Peter S. Wong
*Attorney, Agent, or Firm*—Cushman, Darby & Cushman

[57] ABSTRACT

A transmission light emitting unit emits light on an original placed on an original table. A color change area designating section shifts the light emitted from the transmission light emitting unit to an arbitrary area of an original image which is subjected to change in color of image formation to designate an arbitrary area as a portion subjected to change in color of image formation prior to image formation operation. An original scanner produces an optical image of the original upon completion of scanning of the original. An image forming unit forms an image corresponding to the optical image from the scanner on an image forming medium with predetermined colors according to the designation by the designation section. A color change area display unit has a display element capable of displaying a pattern, for flashing a display pattern corresponding to the area to be subjected to a change in color of image formation and designated by the color change area designating section.

7 Claims, 37 Drawing Figures

IMAGE FORMING APPARATUS WITH COLOR CHANGE AREA DISCRIMINATING FUNCTION

BACKGROUND OF THE INVENTION

This invention generally relates to an image forming apparatus and, more particularly, to an image forming apparatus with a color change area discriminating function, for example, suitable for an electric copying machine.

It is known that copying machines have functions for copying an original image in an equal-, reduced-, or enlarged-size mode. In recent years, various types of copying machines have been developed and used in practice. For example, in one conventional copying machine, an image within a predetermined area of an original is erased or copied in a color different from that of an image outside the predetermined area. In another conventional copying machine, an image outside a predetermined area is simply erased or copied in a color different from that of the image within the area.

An erasure or color change area is designated by a separate key excluded from normal operation keys for image formation. For this reason, it is difficult for an operator to understand an area of interest subjected to erasure or color change designation.

U.S. application Ser. No. 825,876 entitled "Image Forming Apparatus With Area Selection And Preservation Functions" and filed on Feb. 4, 1986 by the same assignee with the present application and allowed on Sep. 29, 1986 by the UNITED STATES DEPARTMENT OF COMMERCE Patent and Trademark Office describes an arrangement having a display unit for allowing easy discrimination of the erasure area. However, it is still difficult to immediately discriminate the color change area by the above-noted arrangement.

SUMMARY OF THE INVENTION

It is, therefore, an object of the present invention to provide a new and improved image forming apparatus with a color change area discriminating function, which allows immediate discrimination of a color change area when the color of a specific area of an image corresponding to an original is to be different from the remaining area and the resultant image is then formed.

According to the present invention, there is provided an image forming apparatus with a color change area discriminating function, the apparatus comprising:

an original table on which a light-transmitting original is placed;

transmission light emitting means, provided movably along said original table, for emitting transmission light through the original placed on the original table;

color change area designating means for shifting the light emitted from said transmission light emitting means to an arbitrary area of an original image which is to be subjected to a change in color of image formation to designate the arbitrary area as a portion to be subjected to a change in color of image formation prior to an image formation operation;

color change area storage means for storing first position data representing the area to be subjected to a change in color of image formation and second position data representing a remaining area excluding the area to be subjected to a change in color of image formation, in response to designation by the color change area designating means;

original scanning means, arranged to optically scan the original placed on the original table, for producing an optical image of the original upon completion of scanning of the original;

image forming means for focusing the optical image of the original which is scanned by the original scanning means and selectively driving first and second developing units respectively containing first and second color agents corresponding to at least basic and change colors, thereby forming an image on an image forming medium with predetermined colors;

image erasing means arranged to selectively erase the image to be formed by the image forming means;

image forming medium returning means arranged to selectively return the image-forming medium with the image formed by the image-forming means to the image forming means;

color change area display means, having a display element capable of displaying a pattern, for flashing a display pattern corresponding to the area to be subjected to a change in color of image formation and designated by the change color area designating means, the display pattern being included in a display pattern corresponding to the original;

first control means for supplying a drive signal to the first developing unit in the image forming means during first image formation operation, reading out from the color change area storage means the first position data representing the area to be subjected to a change in color of image formation and supplying the readout data as an erasure signal to the image erasing means, and supplying a return instruction signal to the imageforming medium-returning means; and second control means for supplying a drive signal to the second developing unit in the image forming means during second image formation operation, reading out from the color change area storage means the second position data representing the area excluding the area to be subjected to a change in color of image formation, and supplying the readout data as an erasure signal to the image erasing means.

BRIEF DESCRIPTION OF THE DRAWINGS

These and other objects and features of the present invention can be understood through the following embodiments by reference to the accompanying drawings, in which:

FIGS. 1 to 24 show a first embodiment of the present invention, in which FIG. 1 is a perspective view showing the outer appearance of an image forming apparatus, FIG. 2 is a side sectional view thereof, FIG. 3 is a plan view showing a control panel thereof, FIG. 5 is a perspective view schematically showing a drive mechanism for an optical system, FIG. 6 is a block diagram of a control circuit, FIG. 7 is a perspective view showing the main part of a spot light source, FIG. 8 is a side sectional view showing the main part of the spot light source, FIGS. 9 and 10 are plan views for explaining erasure area designation of the original by using the spot light source, FIG. 12 is a side sectional view of the main part showing an erasure array disposition, FIGS. 13 and 14 show the relationships between the erasure array and a photosensitive drum, in which FIG. 13 is a perspective view showing the main part thereof and FIG. 14 is a front view thereof, FIGS. 15A and 15B an arrangement of the erasure array, in which FIG. 16 is a circuit diagram of an array driver, FIG. 17 a flow chart for explaining multi-color copying, FIG. 18 is a view showing an original subjected to partial color copying, FIGS. 19 and 20 are views of copied sheets after partial color copying is completed, and FIGS. 21 and 24 are views showing displayed examples in the partial color copy mode; and FIGS. 25 to 29 show a second embodiment of the present invention, in which FIG. 25 is a plan view showing an arrangement of a control panel, FIG. 27 is a flow chart for explaining angle setting of the display unit, and FIGS. 28 and 29 are side sectional views of the main part for explaining angle setting of the display unit.

DETAILED DESCRIPTION OF THE PREFERRED EMBODIMENTS

The present invention will be described with reference to preferred embodiments hereinafter.

Figure 1:
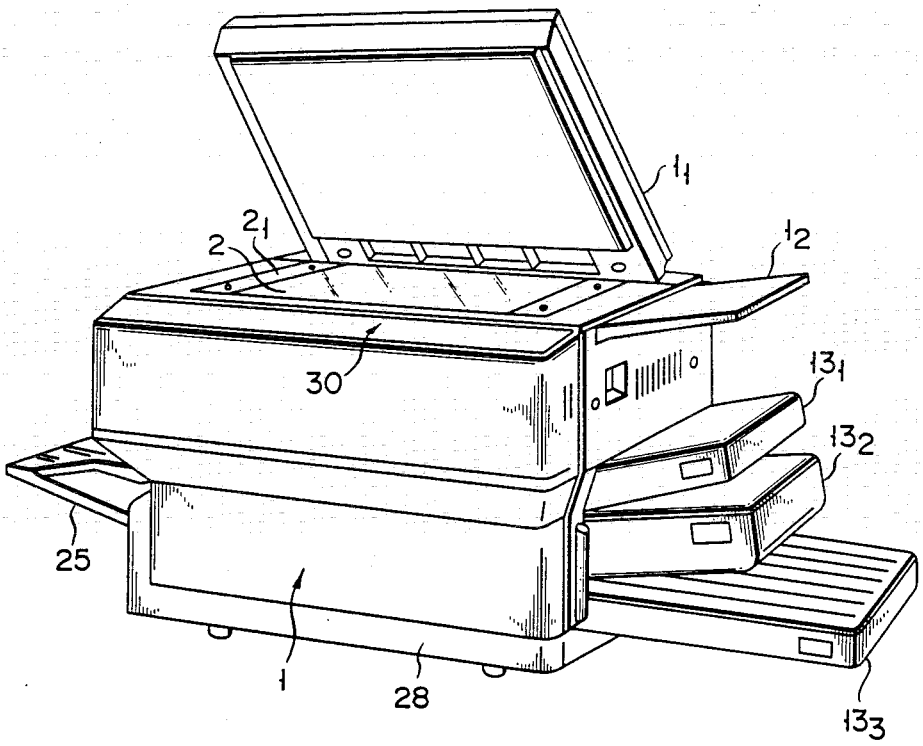
Figure 2:
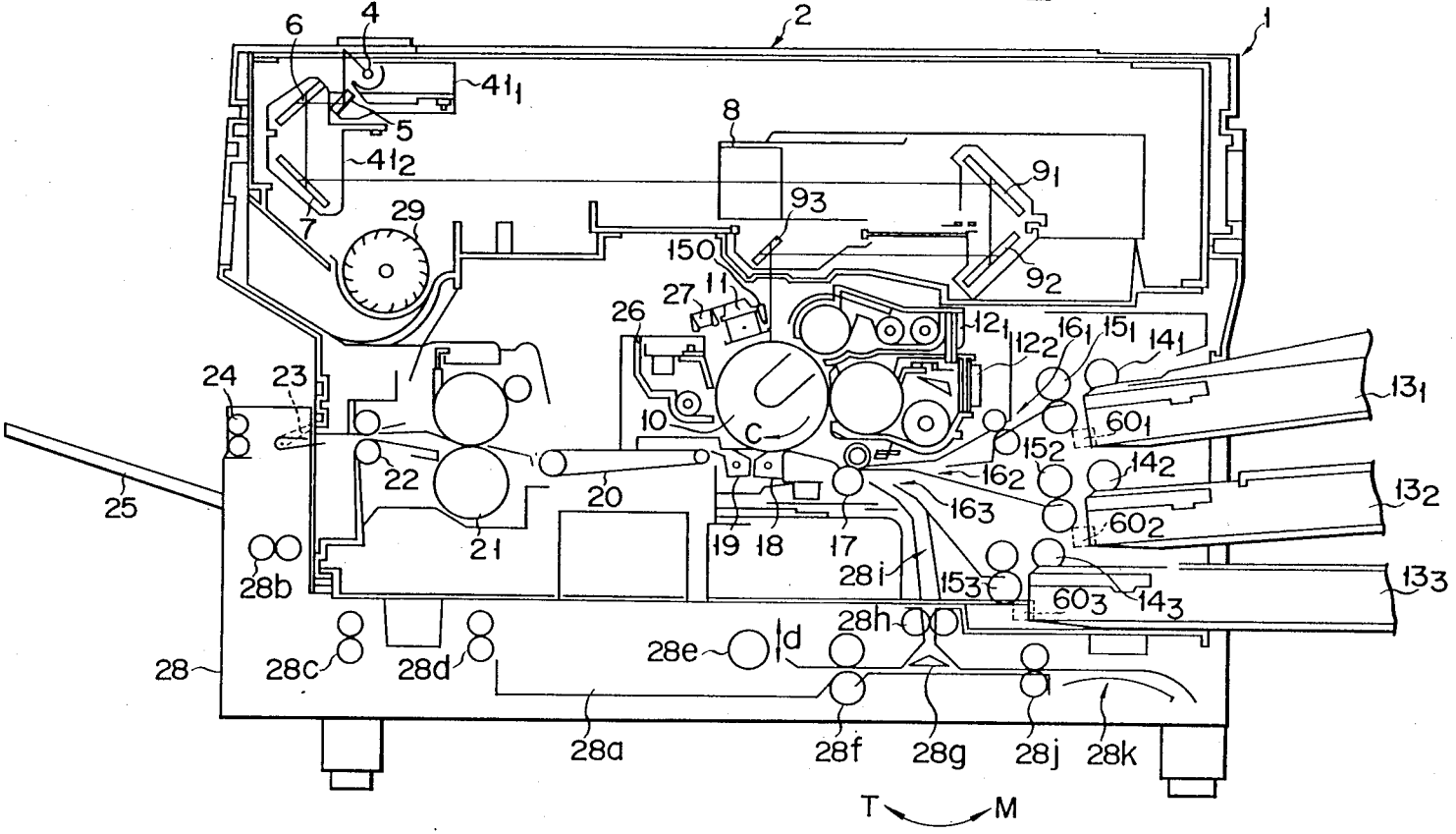

FIGS. 1 and 2 show an image forming apparatus according to a first embodiment of the present invention, exemplifying a copying machine. Reference numeral 1 denotes a copying machine housing. Original table (transparent glass) 2 is fixed on the upper surface of housing 1 to support an original thereon. Fixed scales $2_1$ are disposed at both ends of table 2 and serve as a reference for setting an original on table 2. Openable cover $1_1$ and work table $1_2$ are arranged near table 2. The original placed on table 2 is exposed and scanned when an optical system comprising exposure lamp 4 and mirrors 5, 6, and 7 are reciprocated along the lower surface of table 2 in directions of double-headed arrow a. In this case, mirrors 6 and 7 move at a speed half that of mirror 5 so as to maintain a fixed optical path length. A beam reflected by the original and scanned by optical system 3, that is, irradiated by exposure lamp 4, is reflected by mirrors 5, 6, and 7, transmitted through variable magnification lens block 8, and then reflected by mirror 9 to be projected on photosensitive drum 10.

Drum 10 rotates in a direction of arrow c so that its overall surface is charged first by charger 11. The image of the original is projected on the charged surface of drum 10 by slit exposure, forming an electrostatic latent image on the surface. The latent image is developed into a visible image (toner image) by selectively using developing units $12_1$ and $12_2$ containing, e.g., red and black toners.

Paper sheets (transfer media) P are picked up one by one from paper cassette $13_1$, $13_2$, or $13_3$ by paper feed roller $14_1$, $14_2$, or $14_3$, and roller pair $15_1$, $15_2$ or $15_3$. Each paper sheet P is guided to registration roller pair 17 through paper guide $16_1$, $16_2$, or $16_3$. Roller pair 17 feeds the sheet to a transfer region. Cassettes $13_1$, $13_2$, and $13_3$ are removably attached to the lower right portion of housing 1, and one of the cassettes can be selected by operation on a control panel which will be described in detail later. The sizes of cassettes $13_1$, $13_2$, and $13_3$ are respectively detected by cassette size detection switches $60_1$, $60_2$, and $60_3$. Switches $60_1$, $60_2$, and $60_3$ comprise a plurality of microswitches which are turned on/off upon insertion of cassettes having different sizes.

Sheet P, fed to the transfer region, is brought into tight contact with the surface of photosensitive drum 10 in the space between transfer charger 18 and drum 10. As a result, the toner image is transferred from drum 10 to sheet P by charger 18. After the transfer, sheet P is electrostatically separated by separation charger 19 from drum 10 and transported by conveyor belt 20. Sheet P is then transported to fixing roller pair 21 as a fixing unit arranged at the terminal end portion of belt 20. As sheet P passes through roller pair 21, the transferred image is fixed on sheet P. After the fixation, sheet P is delivered onto tray 25 outside housing 1 through feed-out roller pair 22, selection gate 23, operated as indicated by the solid line, and discharge roller pair 24. Residual toner particles are removed from the surface of drum 10 by cleaner 26 after transfer operation is completed. A residual image on drum 10 is erased by discharge lamp 27 to restore the initial state. Reference numeral 29 in FIG. 2 denotes a cooling fan for preventing the temperature inside housing 1 from rising.

Multiplex copy unit 28 is arranged in the lower portion of housing 1 to perform two-side copying or single-side multiplex copying. Unit 28 includes discharge roller pair 24, and a plurality of roller pairs 28*b*, 28*c*, and 28*d* for guiding a sheet to stacker 28*a* through gate 23. Pickup roller 28*e* is arranged in stacker 28*a* to feed out the sheets temporarily stacked therein. Roller 28*e* can be vertically moved according to the thickness of stacked sheets (i.e., the number of stacked sheets) in directions of double-headed arrow d. The sheets are picked up by roller 28*e* one by one, and each sheet is guided to control gate 28*g* through separation roller pair 28*f*. In the multiplex copy mode, gate 28*g* is pivoted in a direction of arrow M to guide the sheet to registration roller pair 17 through convey roller pair 28*h* and paper guide path 28*i*. However, in the two-side copy mode, gate 28*g* is located in the position illustrated in FIG. 2 to guide the sheet to reversal portion 28*k* through convey roller path 28*j*. When the sheet is stored in reversal portion 28*k*, gate 28*g* is pivoted in a direction of arrow T, and the sheet conveyed by roller convey roller 28*j* is guided to roller pair 17 through pair 28*h* and path 28*i*. In this embodiment, gate 28*g* is normally pivoted in the direction of arrow M, and multiplex copying can be normally performed.

Figure 3:
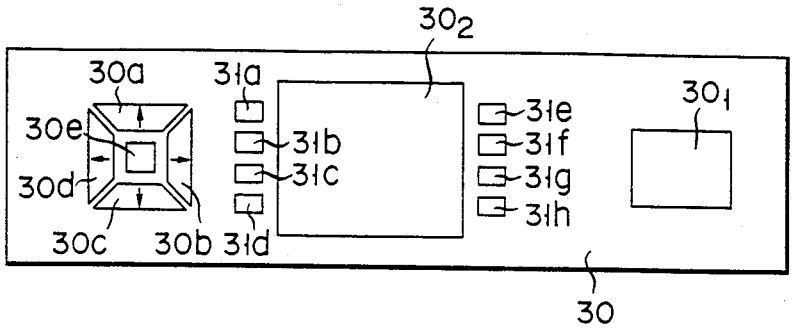

FIG. 3 shows control panel 30. Panel 30 includes copy key $30_1$ for instructing the start of copying and display unit $30_2$ comprising, e.g., a liquid crystal dot matrix display unit. The display contents stored in memory 140 (to be described in detail later) are changed according to given modes. Mode selection keys 31*a*, 31*b*, 31*c*, 31*d*, 31*e*, 31*f*, 31*g*, and 31*h* indicated in display unit $30_2$ are arranged around the display unit.

Control panel 30 also includes operation keys 30*a*, 30*b*, 30*c*, and 30*d* for moving a beam spot representing the designated position on the original, and position designation key 30*e* for inputting coordinates of a point represented by the beam spot.

Figure 4A:
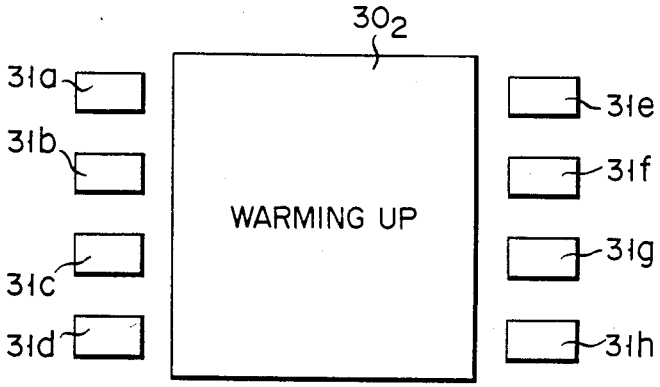
FIGS. 4A to 4D are views showing displayed examples on a display unit.
Figure 4B:
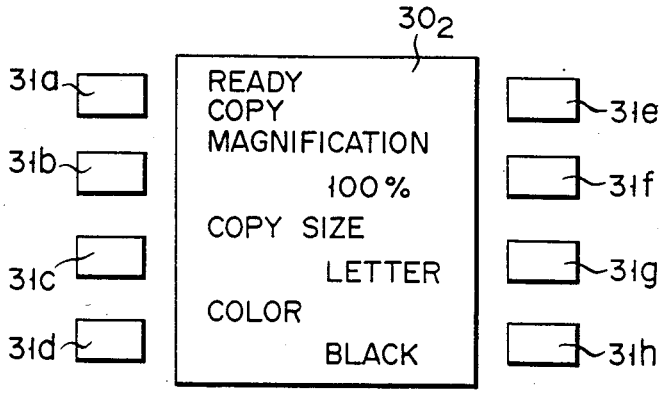
Figure 4C:
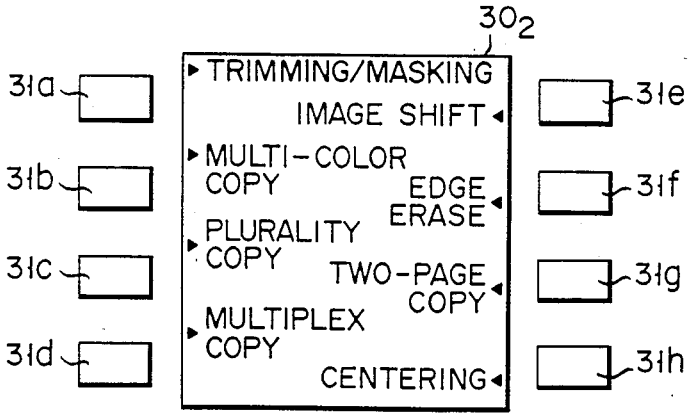
Figure 4D:
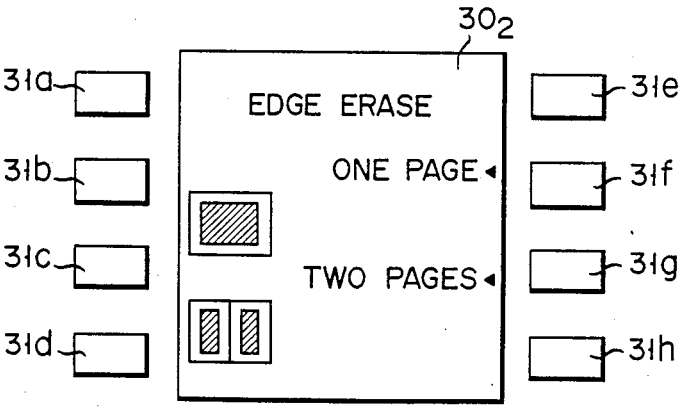
Figure 4E:
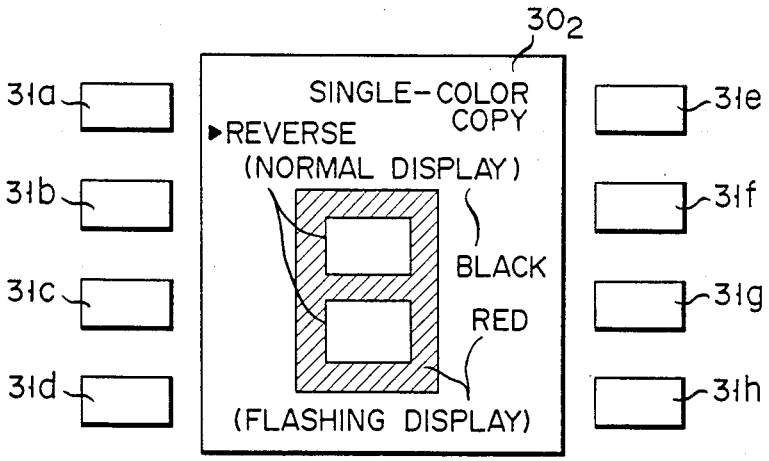
FIGS. 4E and 4F are views showing displayed examples on the display unit in partial color copying.
Figure 4F:
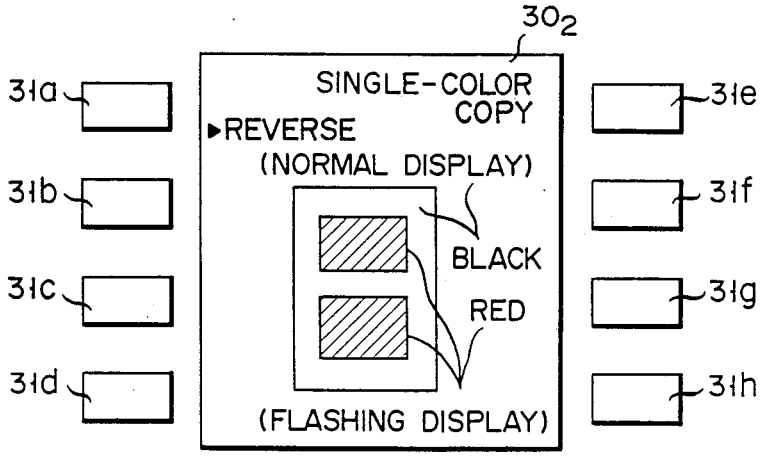

Display unit $30_2$ can perform character display for states of the copying machine, as shown in FIGS. 4A and 4B, graphic display for a trimming/masking mode, an image shift mode, an edge erasure mode, a plurality copy mode, a copy mode using two originals, a multi-color copy mode, a multiplex copy mode, and a centering mode, as shown in FIG. 5C, and graphic display for a mode using one or two originals in the edge mode and a single—(partial) color copy mode, as shown in FIGS. 4D to 4F.

Figure 5:
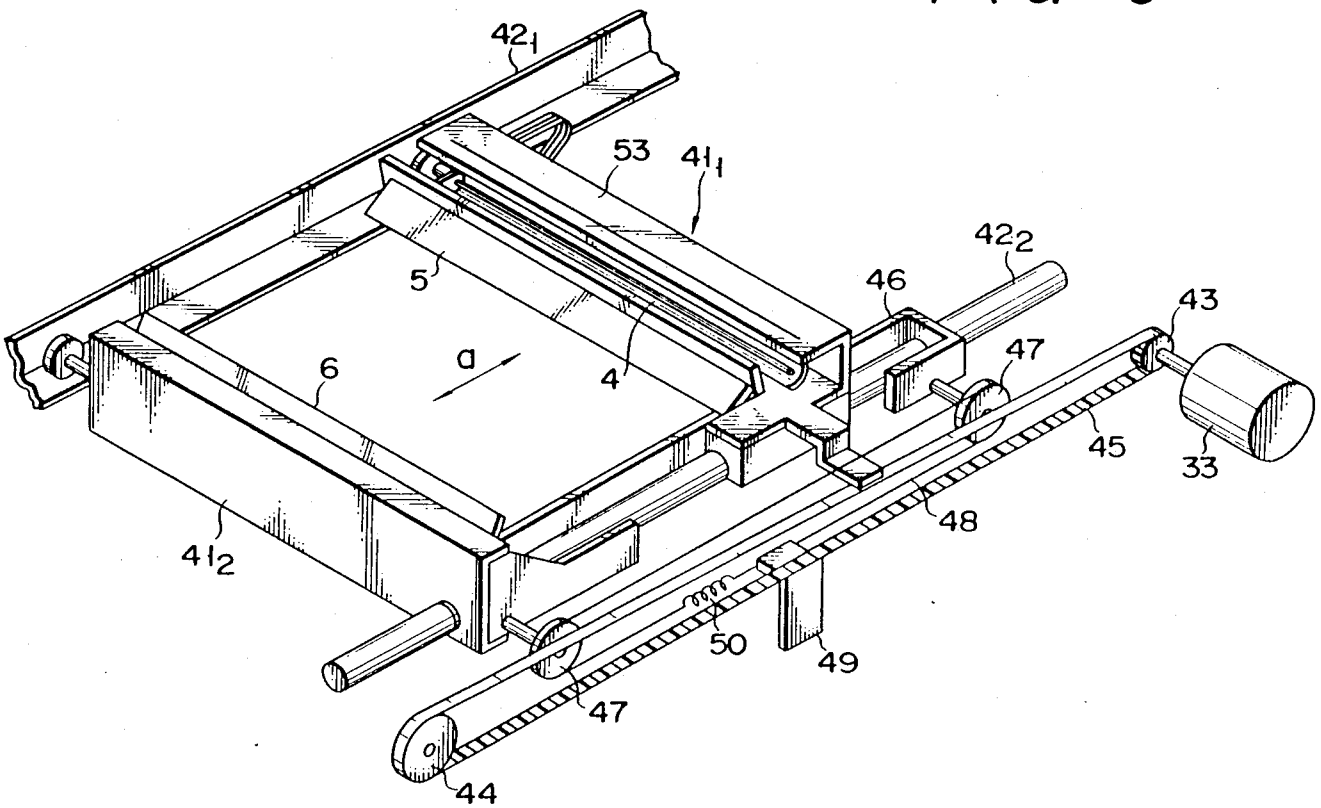

FIG. 5 shows a drive mechanism for reciprocating the optical system. Mirror 5 and exposure lamp 4 are supported by first carriage $41_1$, and mirrors 6 and 7 are supported by second carriage $41_2$. Carriages $41_1$ and $41_2$ are guided by guide rails $42_1$ and $42_2$ and can be moved in the directions of double-headed arrow a. More specifically, 4-phase stepping motor 33 drives pulley 43. Endless belt 45 is looped between pulley 43 and idler pulley 44. One end of carriage $41_1$ for supporting mirror 5 is fixed at an intermediate portion of belt 45. Two pulleys 47, spaced apart from each other, are rotatably mounted on guide portion 46 in carriage $42_2$ for supporting mirrors 6 and 7. Wire 48 is looped between pulleys 47. One end of wire 48 is fixed to fixing portion 49, and the other end thereof is fixed to fixing portion 49 through coil spring 50. One end of carriage $41_1$ is fixed at an intermediate portion of wire 48. Upon rotation of stepping motor 33, belt 45 is rotated to move carriage $41_1$. Upon movement of carriage $41_1$, second carriage $42_2$ is moved. In this case, since pulleys 47 serve as movable rollers, carriage $41_2$ is moved at a speed half that of carriage $41_1$ in the same direction. The direction of movement of carriages $41_1$ and $41_2$ can be controlled by reversing the rotational direction of motor 33.

Carriage $41_1$ can be moved to a predetermined position (i.e., a home position determined by a given magnification) upon driving of motor 33, according to a paper size and a desired magnification. When an operator depresses copy key $30_1$, carriage $41_1$ is moved first toward carriage $41_2$. Thereafter, lamp 4 is turned on and carriage $41_1$ is moved away from carriage $41_2$. When scanning of the original is completed, lamp 4 is turned off, and carriage $41_1$ is returned to the home position.

Figure 6:
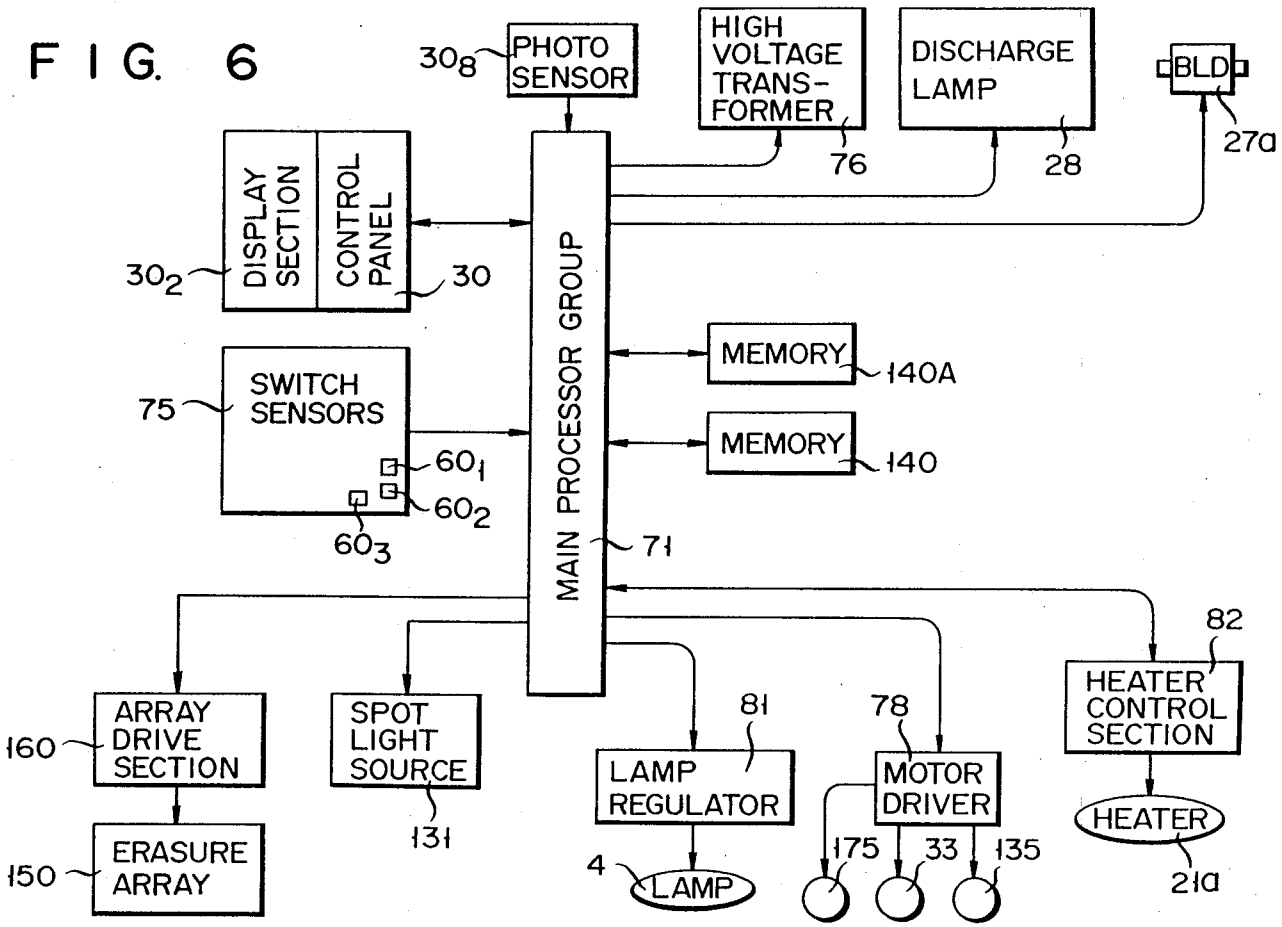

FIG. 6 shows the overall arrangement of a control circuit. Main processor group 71 detects inputs from control panel 30, various switches and sensors, e.g., input equipment 75, such as cassette size detection switches $60_1$, $60_2$, and $60_3$. Group 71 controls high voltage transformer 76 for driving various chargers, discharge lamp 28, blade solenoid 27*a* for cleaner 27, heater 21*a* for fixing roller pair 21, exposure lamp 4, and motor 33 to perform copying. At the same time, group 71 controls spot light source 131, stepping motors 33 and 135, memory 140, erasure array 150, and array driver 160 to erase an undesired area of the original image. Light source 131, pulse motor 135, erasure array 150, array driver 160, and memory 140 will be described later.

Main processor group 71 causes display unit $30_2$ to display characters and patterns according to character or graphic data read out from memory 140A. A quick disk or the like may be used as memory 140A.

Exposure lamp 4 is controlled by main processor group 71 through lamp regulator 81, and heater 23*a* is controlled by group 71 through heater control section 82.

Figure 7:
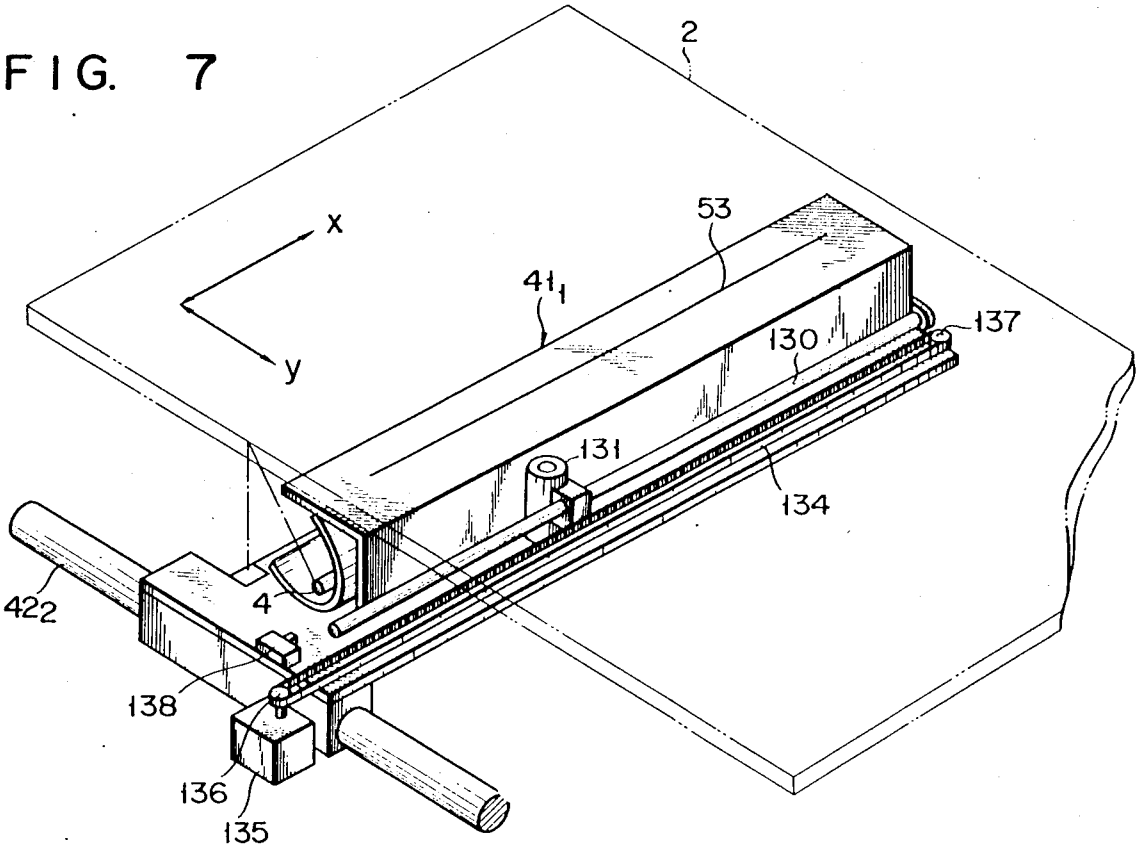
Figure 8:
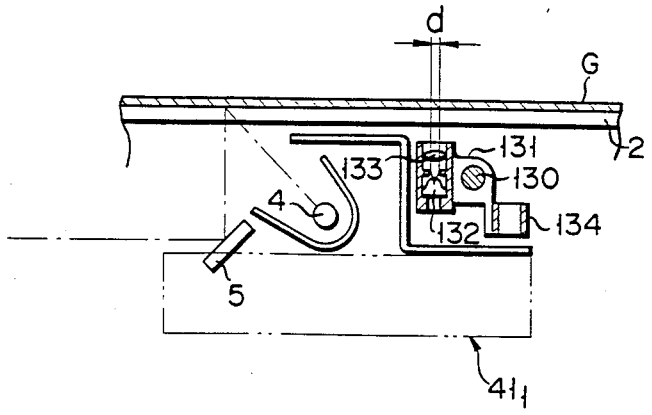

A means for erasing an undesired area of the original image will be described below. Referring to FIGS. 7 and 8, guide shaft 130 is mounted on a portion of first carriage $41_1$ which shields light from lamp 4, and extends along lamp 4. Spot light source 131 is movably mounted on guide shaft 130 and serves as a means for designating an erasure range of the original. Light source 131 comprises light-emitting element 132 (e.g., a light-emitting diode or lamp) and lens 133, both of which are arranged to oppose original table 2. Light generated by element 132 is focused by lens 133 to form a beam spot having diameter d on table 2.

Spot light source 131 is coupled to timing belt 134 (toothed belt) extending along guide shaft 130. Belt 134 is looped between driven pulley 137 and pulley 136 mounted on the rotating shaft of motor 135. Upon rotation of motor 135, light source 131 is moved in a direction perpendicular to the scanning direction of carriage $41_1$. Position sensor 138 comprising a microswitch is arranged on carriage $41_1$ located at the motor 135 edge of guide shaft 130 to detect the initial position of light source 131. Assuming that light source 131 is moved, light source 131 abuts against sensor 138 to detect the initial position.

A method of designating with light source 131 the area of the original which is not desired to be copied will be described with reference to FIGS. 9 and 10. In order to designate the erasure area, original G is set at the side of fixed scale $2_1$ such that the image surface faces downward on the original table. In this state, when operation keys 30*a* to 30*d* are selectively operated, spot light source 131 is moved while light-emitting element 132 is kept on. Upon depression of key 30*b* or 30*d*, motor 33 is driven to move first carriage $41_1$ and light source 131 in one of directions (indicated by double-headed arrow y in FIG. 9). Upon depression of key 30*a* or 30*c*, motor 135 is driven to move light source 131 in a direction perpendicular to the scanning direction (indicated by double-headed arrow x in FIG. 9).

The operator selectively manipulates operation keys 30*a* to 30*d* while visually checking the beam spot transmitted through original G in multi-color mode designation. For example, the operator depresses position designation key 30*e* after the beam spot is moved to point S1 on original G in FIG. 10. Coordinate data representing point S1 is stored in main processor group 71 in FIG. 6. Similarly, when key 30*e* is depressed after the beam spot is moved to point S2 on original G, the coordinate data of point S2 is stored in main controller group 71. The position of the beam spot can be detected by counting the numbers of drive pulses required for drive motors 33 and 135 to move the spot to this position. Thereafter, as shown in FIG. 10, a rectangular area (indicated by the hatched region) having points S1′ and S2′ as diagonal points of outer edge Wb of frame W defined by points S1 and S2 is designated as an erasure area for one color (the basic color or black).

A rectangular area (indicated by the hatched region) having points S1″ and S2″ as diagonal points of inner edge Wa of frame W defined by points S1 and S2 is designated as an erasure area for the other color (red).

Figure 11A:
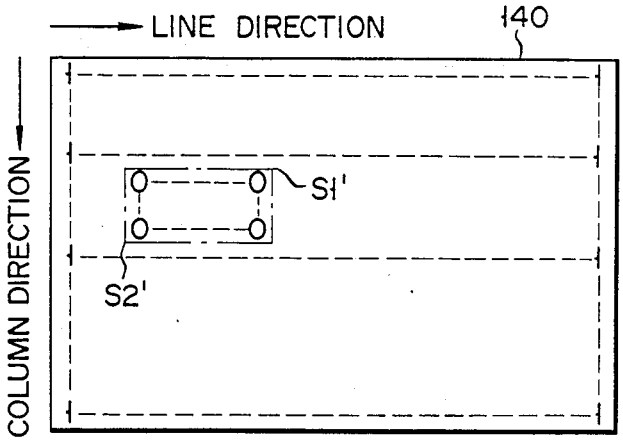
FIGS. 11A and 11B are views for explaining the memory contents.

When the erasure areas are thus designated, main processor group 71 performs predetermined arithmetic operations on the basis of the designated two points of each area and its copy magnification. A high level signal "1" is set for the erasure areas in memory 140, and a low level signal "0" is set for the remaining area therein. Memory 140 comprises a RAM designed such that a capacity along the column direction matches with a value obtained by a calculation (X-direction moving distance of spot light source 131)÷(Y-direction positional resolution). In response to data from processor group 71, a high level signal is stored at addresses corresponding to the hatched region and a low level signal is stored at addresses corresponding to the remaining region, as shown in FIG. 11A for one color (the basic color) and FIG. 11B for the other color.

Figure 9:
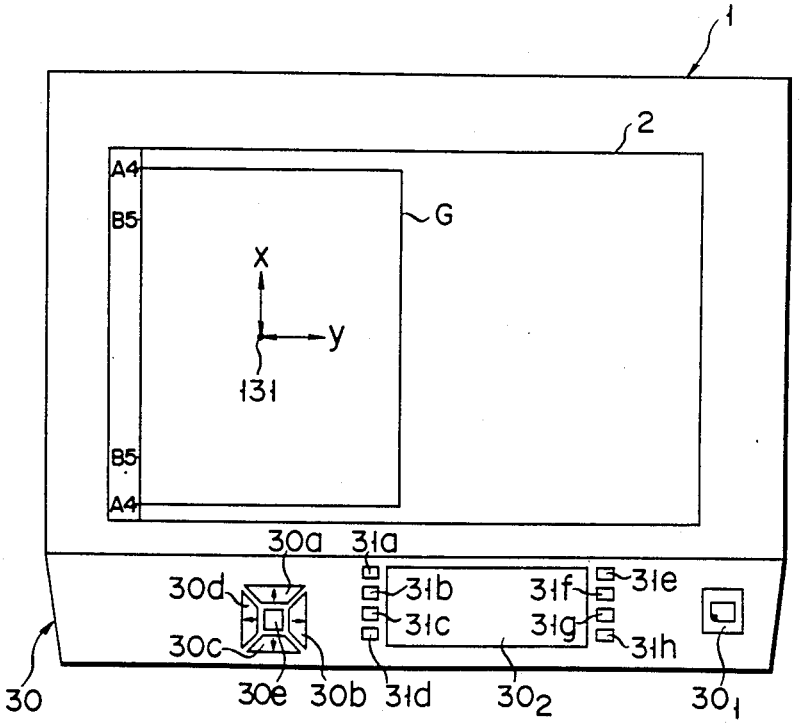
Figure 10:
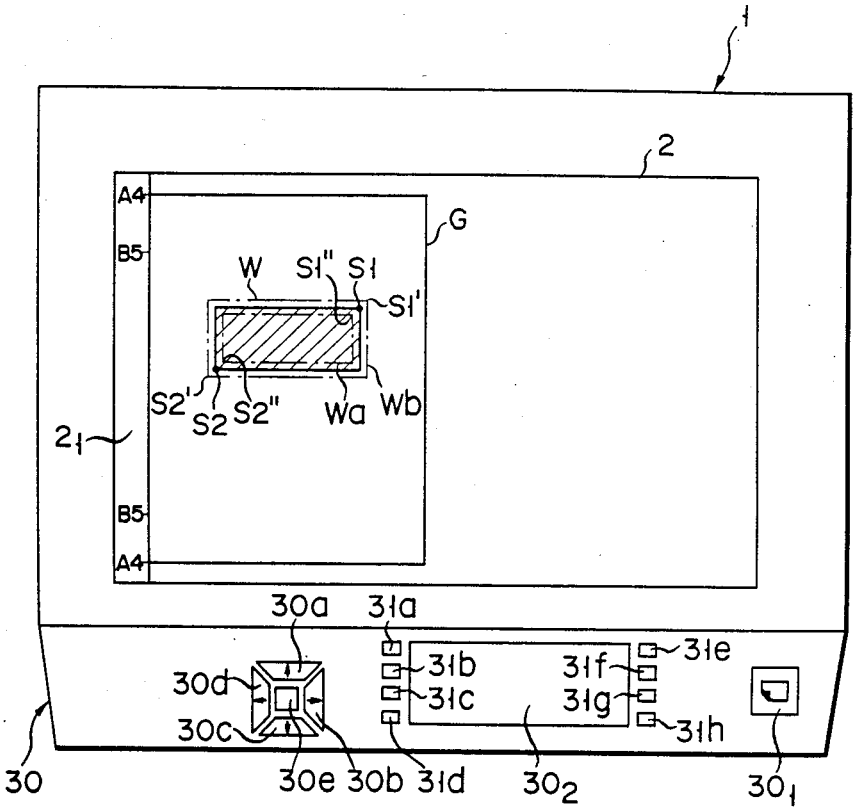

Upon completion of erasure area designation, original G is reversed in the Y direction in FIG. 9. Original G is then set and copied on the original table such that its image surface faces downward at the side of fixed scale $2_1$. In this case, the original image is assigned to the erasure data stored in memory 140.

Figure 12:
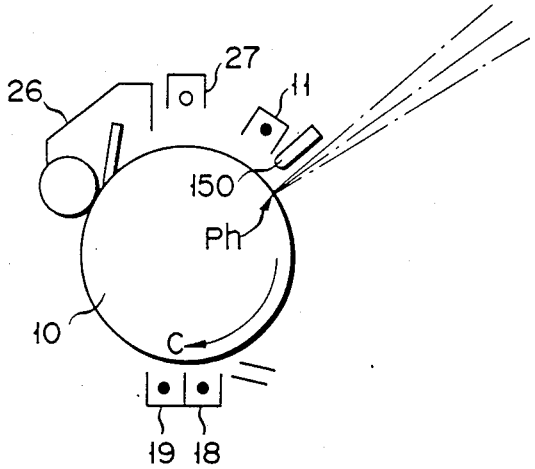
Figure 13:
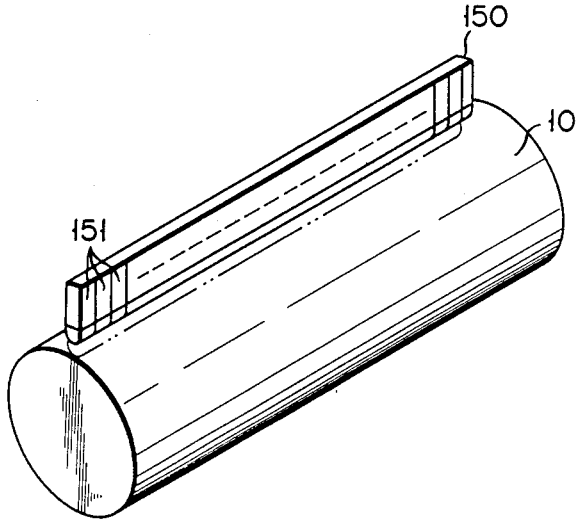
Figure 14:
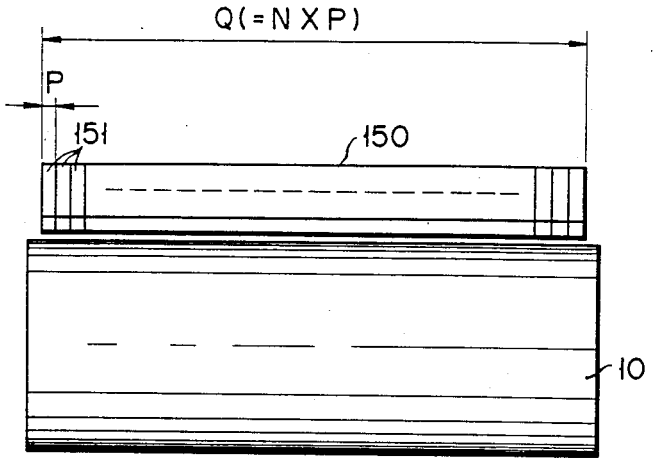
Figure 15A:
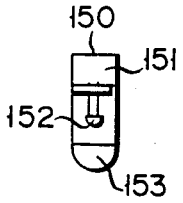
FIG. 15A is a side sectional view thereof and FIG. 15B is a partially cutaway front view thereof.
Figure 15B:
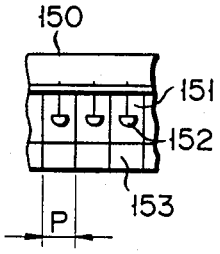

As shown in FIG. 12, erasure array 150 as an erasing means is disposed near photosensitive drum 10 between charger 11 and exposure region Ph. As shown in FIGS. 13 and 14, array 150 has a plurality of lightshielding cells 151 aligned in a direction perpendicular to the rotational direction of photosensitive drum 10. Each cell has light-emitting element 152 such as a light-emitting diode, as shown in FIGS. 15A and 15B. Lens 153 is disposed at the cell opening opposite drum 10 to focus light from corresponding light-emitting element 152 onto the surface of drum 10. The number of light-emitting elements arranged in array 150 corresponds to the capacity of memory 140 along the column direction. If the distance between two adjacent lightemitting elements 152 is given as P and the number of elements 152 is given as N, the overall length of array 150 is $Q=N\times P$.

Figure 16:
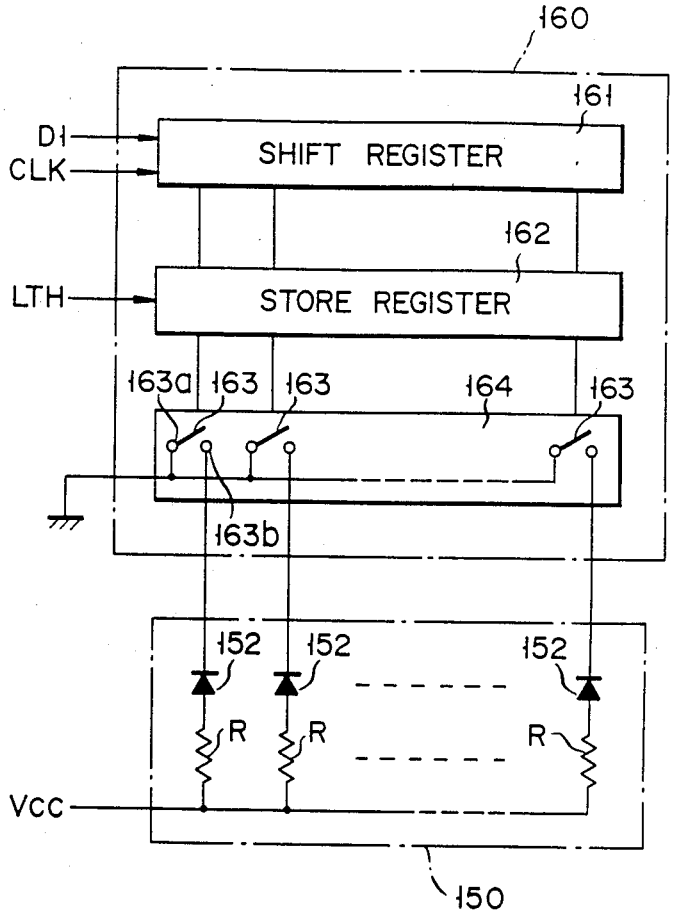

Erasure array 150 is driven by array driver 160. As shown in FIG. 16, driver 16 comprises shift register 161 having the same number of bits as that of column-direction bits of memory 140, store register 162 for storing the contents of register 161, and switch circuit 164 consisting of a plurality of switch elements 163, the ON/-OFF operation of which is controlled in response to each output signal from register 162. Movable contacts 163*a* of elements 163 are grounded, and stationary contacts 163*b* thereof are respectively connected to the cathodes of light-emitting elements 152 constituting erasure array 150. The anodes of elements 152 are connected to power source Vcc respectively through currentlimiting resistors R.

After, as the erasure area the unnecessary portion of the original is designated, the operator closes original cover $1_1$ and depresses copy key $30_1$. First carriage $41_1$ and photosensitive drum 10 are actuated, and one-rank data is sequentially read out in the line direction (FIG. 11) from memory 140. Readout data D1 is transferred to shift register 161 in array driver 160 in response to clock signal CLK. When the one-rank data is completely transferred to register 161 and a charged portion of drum 10 reaches erasure array 150, main processor group 71 generates latch signal LTH. In response to this signal, the storage data is supplied from register 161 to register 162. Since array 150 is located between charger 11 and exposure region Ph, the output timing of signal LTH is controlled such that the one-rank data output from memory 140 is supplied to register 162 prior to $\theta 1/\omega$ where $\theta 1$ is the angle formed between array 150 and exposure region Ph and $\omega$ is the angular speed of drum 10.

Each switch element 163 in switch circuit 164 is controlled in response to an output signal from store register 162. If the output level of register 162 is high level, element 163 is turned on. Otherwise, element 163 is turned off. As a result, light-emitting elements 152 connected to switch elements 163 are turned on if corresponding switch elements 163 are turned on. Otherwise, they are turned off. A charged portion of drum 10 which is partially exposed with light from ON elements 152, and the exposed portion is discharged. Even if the discharged portion is exposed with light again, no latent image is formed thereon. As a result, the corresponding original image portion has been erased. In the manner as described above, each one-rank data is read out from memory 140 and is subjected to image erasure.

Figure 17:
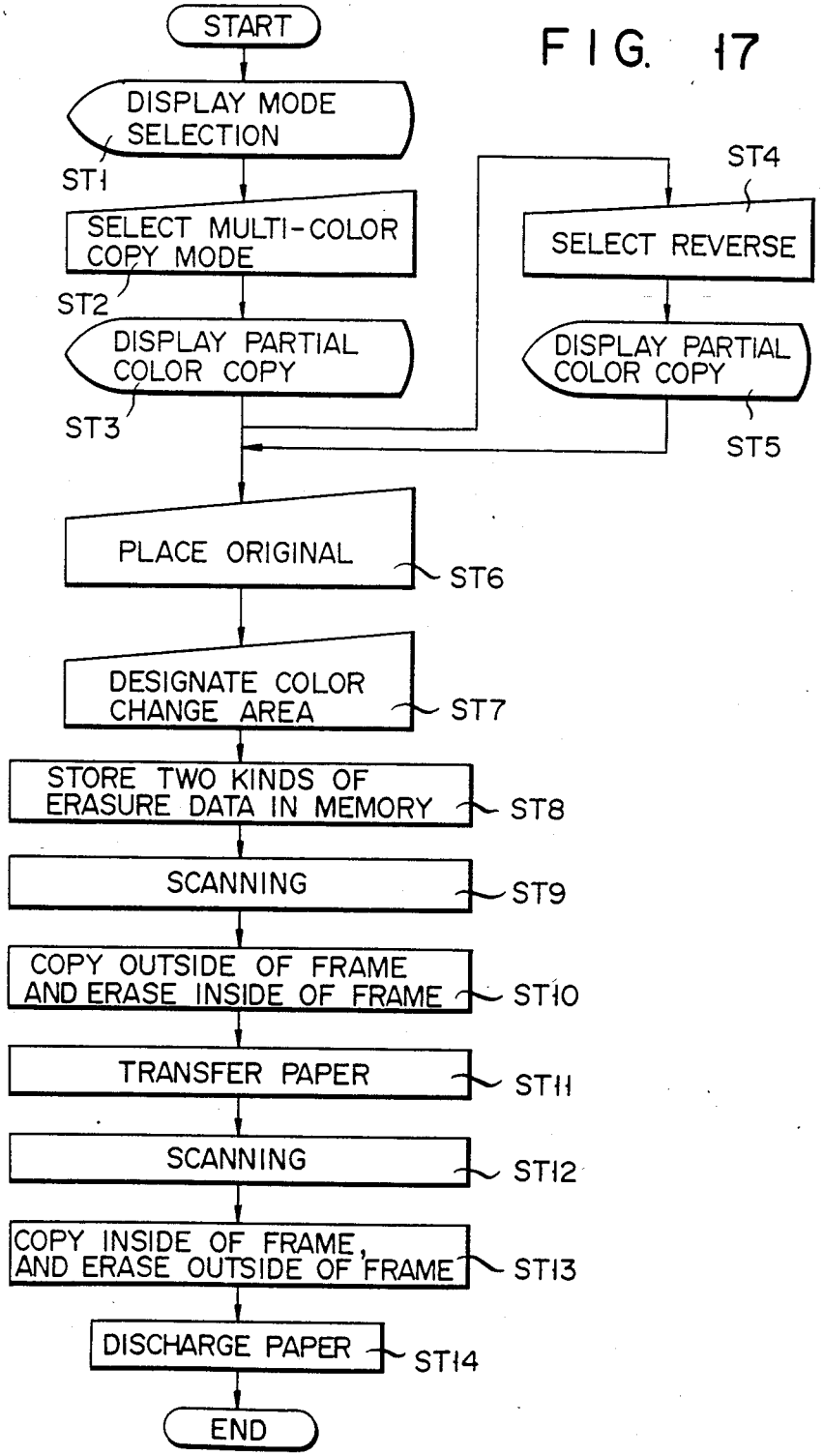

The operation of the copying machine having the above arrangement according to the first embodiment will be described with reference to a flow chart in FIG. 17. In a mode designation state (ST1) shown in FIG. 4C, the operator depresses key 31*b* to select a multicolor (color change) mode (ST2). The image representing the area of reversal of color change, as shown in FIG. 4E, is displayed upon depression of key 31*a*, and at the same time a pattern in a combination of the original frame and at least one designated area (i.e., a pattern frame) is displayed (ST3). In this case, the outside of the pattern frame, i.e., the basic color (black) area, is displayed in a normal display state, i.e., lighting display state. The inside of the pattern frame, i.e., the change color (red) area, is displayed in a flashing display state. At the same time, the word (BLACK) representing the basic color is displayed, and the word (RED) representing the change color flashes, thereby indicating partial color display.

Figure 11B:
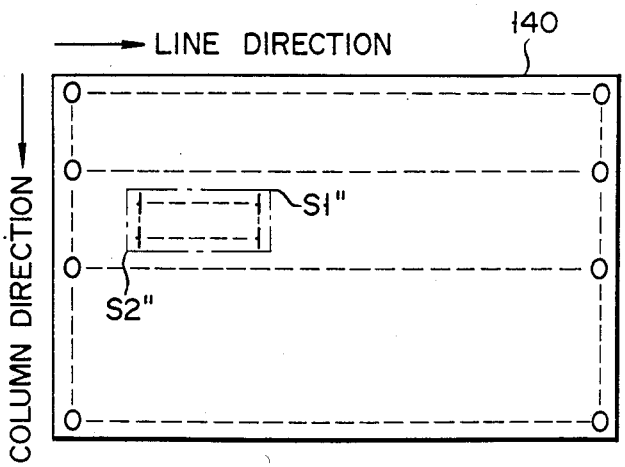
Figure 18:
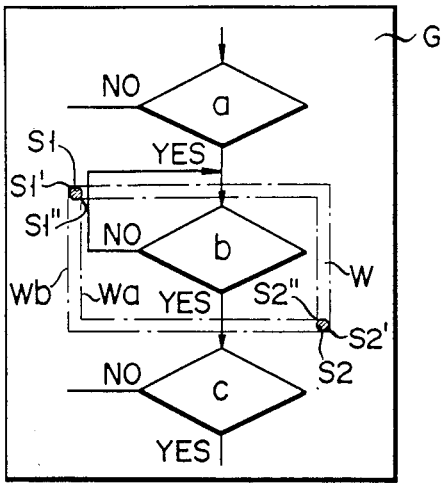

As is described in the flow chart of FIG. 18, the operator turns over original G and places it on original table 2 (ST6). The operator then uses operation keys 30*a* to 30*d* and position designation key 30*e* to designate points S1 and S2 defining the color change area on original G (ST7). Main processor group 71 performs arithmetic operations on the basis of inner and outer edges Wa and Wb, i.e., positions of two points S1″ and S2″ and positions of two points S1′ and S1′ designated by spot light source 131 in frame W. As shown in FIG. 11A, as red area erasure data, the high level signal is stored at addresses in memory 140 corresponding to the inside of outer edge Wb of frame W which is designated by spot light source 131, and the low level signal is stored therein at addresses corresponding to the outside of outer edge Wb which is designated by source 131. As shown in FIG. 11B, as black area erasure data, the high level signal is stored at addresses corresponding to the outside of inner edge Wa of frame W which is designated by source 131, and the low level signal is stored at addresses corresponding to the inside of inner edge Wa which is designated by source 131 (ST8).

In this state, when the operator depresses copy key $30_1$; developing unit $12_1$ containing the black toner and erasure array 150 are used to perform copying except for the color change area of original G. In this case, first carriage $41_1$ is moved to scan and expose original G (ST9).

Figure 19:
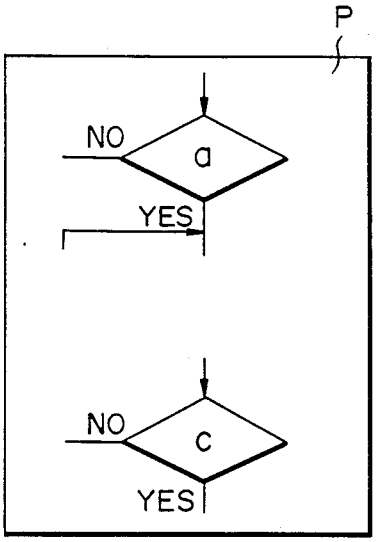

Red area erasure data in FIG. 11A is supplied from memory 140 to array driver 160, and driver 160 is driven on the basis of this erasure data. The electric charge of the inside area of outer edge Wb of frame W is removed from photosensitive drum 10 (ST10). When the resultant image is developed and transferred, only the area excluding the area surrounded by outer edge Wb of frame W of original G is copied on sheet P, as shown in FIG. 19.

Thereafter, copied sheet P is transported to the transfer region again by multiplex copy unit 28 (ST11). In this case, developing unit $12_2$ containing the red toner and erasure array 150 are used to perform copying of the color change area of original G. First carriage $41_1$ is moved to expose and scan original G (ST12).

Figure 20:
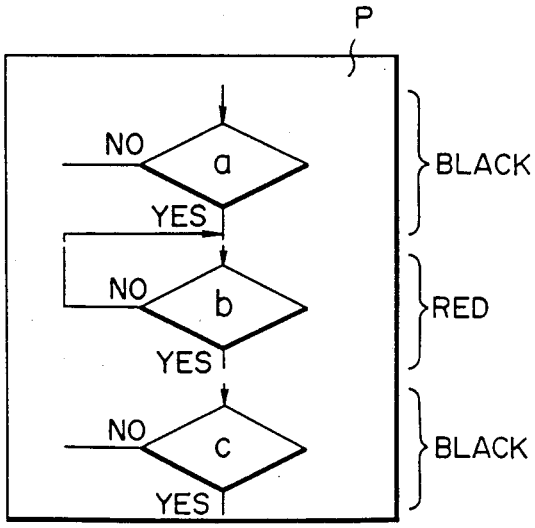

The red area erasure data in FIG. 11B is supplied from memory 140 to array driver 160. Erasure array 150 is operated on the basis of this erasure data. The electric charge of the area outside inner edge Wa of frame W is removed from photosensitive drum 10 (ST13). Therefore, the area surrounded by inner edge Wa of frame W of original G is copied in red on the surface of drum 10. In synchronism with this timing, sheet P is supplied to the transfer region by multiplex copy unit 28, and an image of the area surrounded by inner edge Wa of frame W is transferred onto sheet P. Therefore, the image of the area excluding the area surrounded by outer edge Wb of frame W of original G is copied in black on sheet P, and an image of the area surrounded by inner edge Wa of frame W is formed in red thereon, as shown in FIG. 20. Sheet P is then discharged in discharge tray 25 through discharge roller pair 24 (ST14).

Clear copying can be performed without causing overlapping of the images in the color change mode.

In response to display in step 3, the operator turns on selection key 31*a* to select reversal of the image (ST4). On display unit $30_2$, the inside of the pattern area, i.e., the basic color (black) area, is displayed in the normal display state, and the outside of the pattern area, i.e., the color change (red) area, flashes, as shown in FIG. 4F, thereby performing partial color display. At the same time, the word (BLACK) representing the basic color is displayed, and the word (RED) representing the change color flashes to perform partial color display (ST5). Thereafter, the operations in steps 6 to 14 are performed to obtain a clear composite image without overlapping between the red and black image portions.

As described above, in the color change mode, i.e., in an operation wherein predetermined areas of a single original are copied in different colors, the area corresponding to the basic color is displayed in the normal display state and the area corresponding to the change color flashes. At the same time, words representing the basic color are displayed, and words representing the change color flash. The operator can easily understand which area of the original is subjected to change in color of image formation and hence can distinguish the area of one color from the area of the other color.

Figure 21:
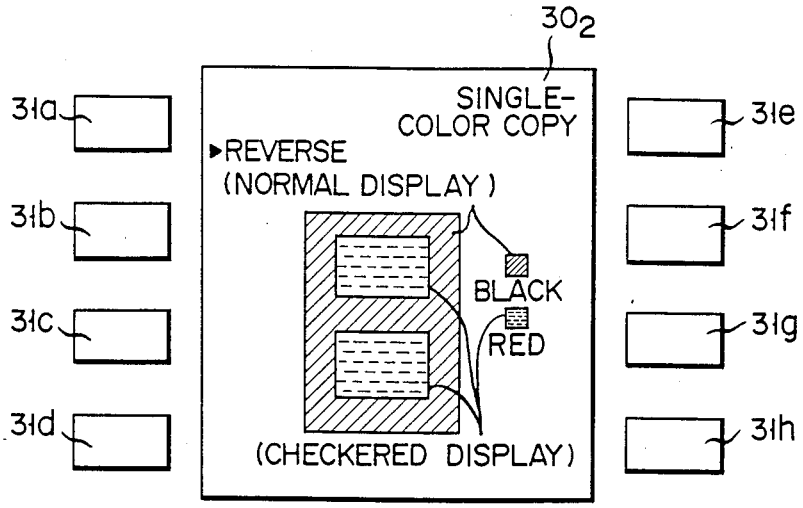
Figure 22:
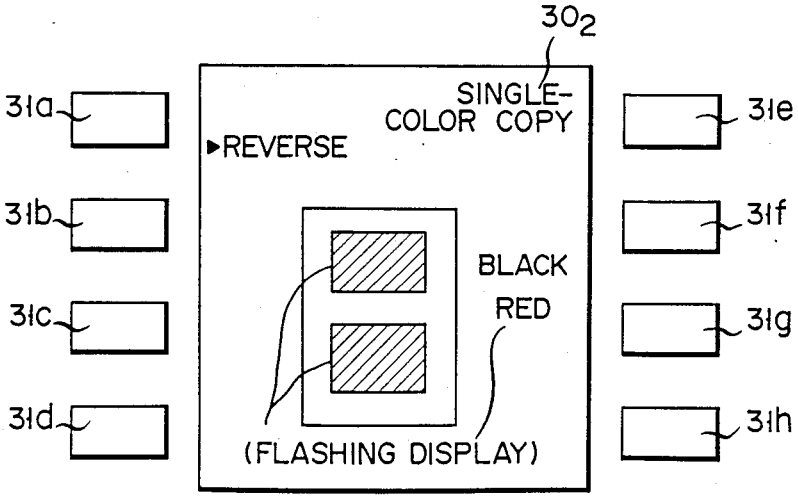
Figure 23:
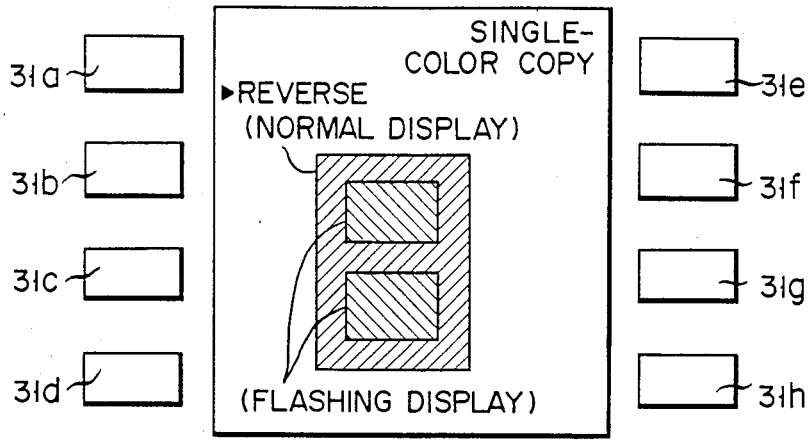
Figure 24:
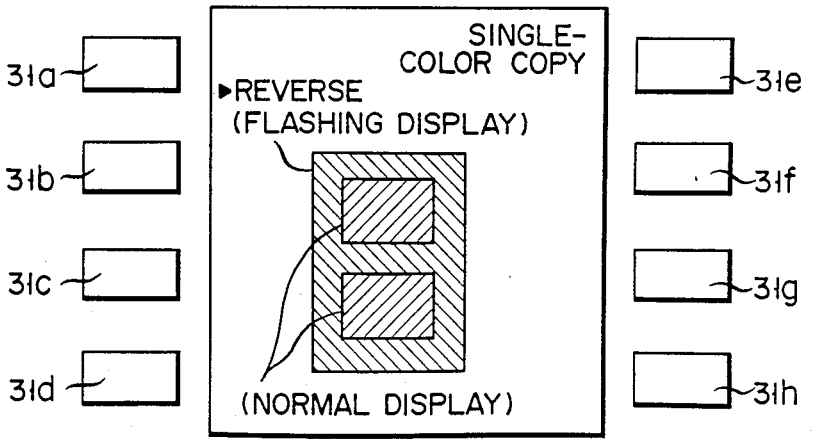

In the above embodiment, the area corresponding to the basic color is displayed in the normal display state and the area corresponding to the change color flashes. At the same time, words representing the basic color are displayed, and words representing the change color flash. However, as shown in FIG. 21, the area and letters which correspond to the change color may be displayed in a checkered pattern. Alternatively, as shown in FIG. 22, only the area and the word corresponding to the change color may flash, and display for the area and the word corresponding to the basic color may be omitted. Furthermore, as shown in FIGS. 23 and 24, the color word may be eliminated from the displayed contents, and the area corresponding to the basic color may be displayed in the normal state, and the area corresponding to the change color may be displayed in the flashing state.

A second embodiment of the present invention will be described below. The second embodiment is associated with an improvement in display unit $30_2$ of the first embodiment. Unit $30_2$ comprises a liquid crystal dot matrix display unit (i.e., a liquid crystal display panel).

In general, a liquid crystal display unit displays desired information by reflecting external light by the surface of the display unit. A sufficient amount of light is not often incident on the liquid crystal display panel, depending on the relationship between the position of the operator's eye and the position of a light source installed on a ceiling or the like, thereby darkening the displayed contents. On the contrary, light from the light source may be directly incident on the surface of the liquid crystal display panel and may be totally reflected thereby. In such cases, the operator cannot clearly observe the displayed contents.

In the second embodiment, the liquid crystal display panel is arranged as display unit $30_2$ in the image forming apparatus of the first embodiment and can be pivoted by a motor. At the same time, a photosensor is arranged in the display unit to detect a light source located near the copying machine. The motor is driven in response to an output signal from the photosensor. Therefore, the display unit is pivoted to a position where reflected light of the light source is not incident on the eyes of the operator, and the displayed contents on the liquid display panel are easily recognized.

Only the arrangement of the second embodiment differing from the first embodiment will be described below.

Figure 25:
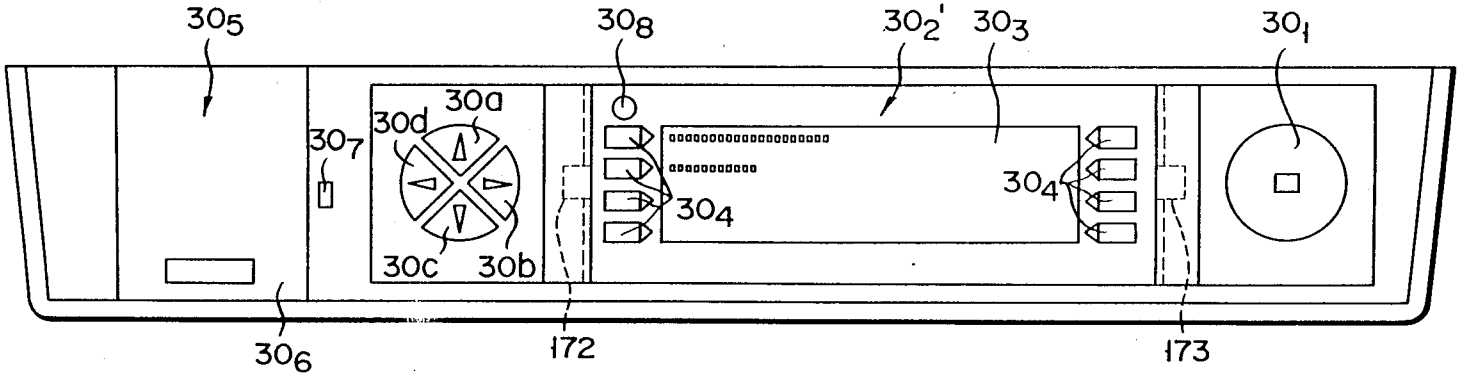

FIG. 25 shows control panel 30A arranged on housing 1. Panel 30A includes copy key $30_1$ for instructing the start of copying, display unit $30_2'$ pivotal about panel 30A, liquid crystal display panel $30_3$, selection keys $30_4$ (corresponding to selection keys 31*a* to 31*h* in the first embodiment), quick disk unit $30_5$, eject key $30_7$ for opening cover $30_6$ of unit $30_5$ and ejecting a quick disk (corresponding to memory 140A in the first embodiment) therefrom, and operation keys 30*a* to 30*d* for moving spot light source 131 to a desired position. Photosensor sensor $30_8$ is arranged on panel 30A to detect a light source located near the copying machine. Panel $30_3$ has the same display functions as those of display unit $30_2$.

The gist of the second embodiment lies in the fact that display unit $30_2$ on control panel 30A is pivoted in response to an output signal from photosensor $30_8$ arranged in display unit $30_2$.

Figure 26A:
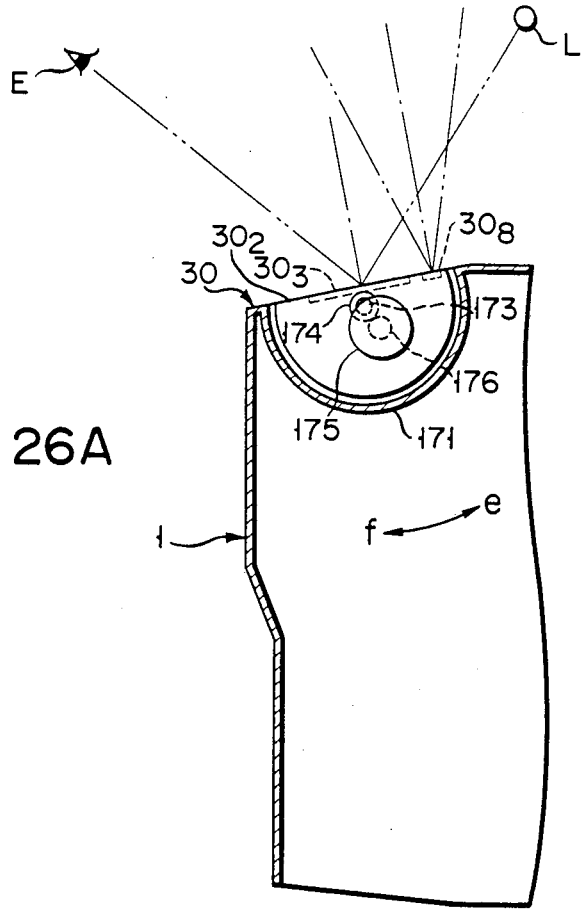
FIG. 26A is a side sectional view of the main part showing a display unit.
Figure 26B:
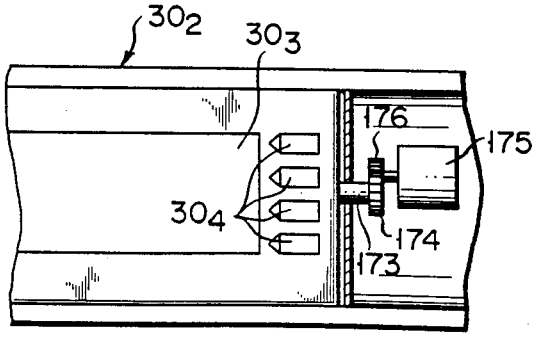
FIG. 26B is a plan view of the main part showing a driving means for the display unit.

As shown in FIG. 26A, recess 171 having a semicircular section is formed at a position in control panel 30A corresponding to display unit $30_2'$. The rear portion of display unit $30_2'$ has a corresponding semicircular section and can be fitted in recess 171. Shafts 172 and 173 extend along the longitudinal direction of unit $30_2'$ between both ends thereof, as shown in FIG. 25. Shafts 172 and 173 are rotatable between both ends of recess 171. Gear 174 is mounted on shaft 173, as shown in FIG. 26B. Gear 176 mounted on the rotating shaft of stepping motor 175 is meshed with gear 174. Panel $30_3$ and selection keys $30_4$ are connected to other circuits through through holes formed in a wall defining recess 171 and the rear portion of display unit $30_2'$ via wirings.

Figure 27:
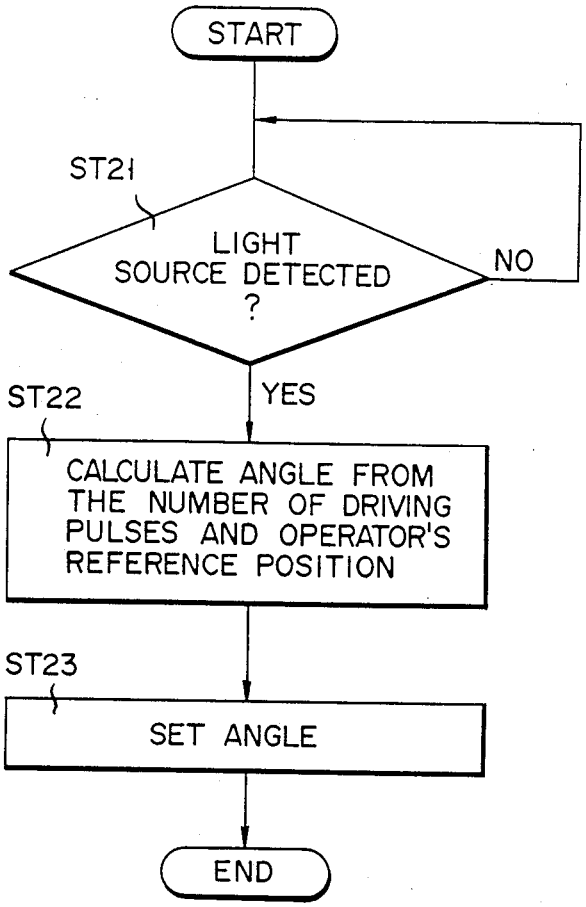
Figure 29:
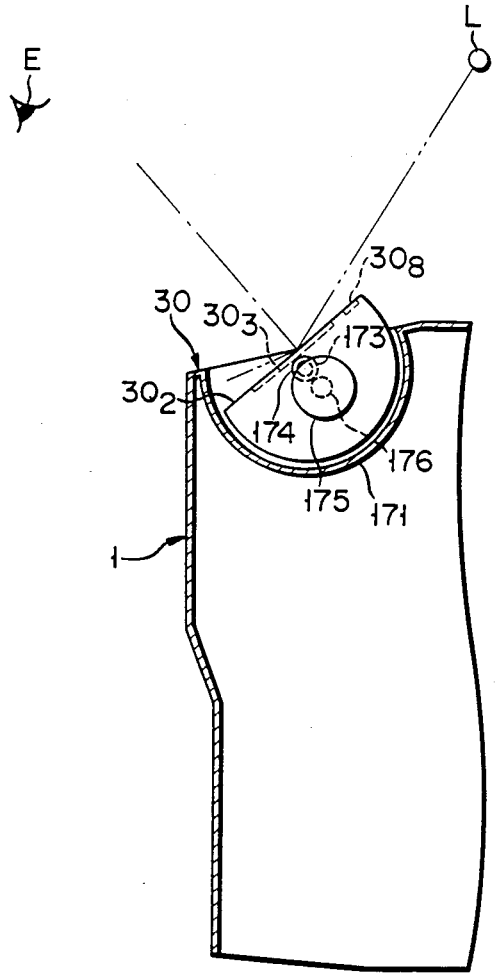

The operation of the above arrangement will be described below. As shown in FIG. 26A, display unit $30_2'$ has the same surface level as that of control panel 30A. In this state, if the relationship between the position of eye E of the operator and the position of light source L is given, as shown in FIG. 26A, reflected light from source L is incident on eye E of the operator. In this state, the operator cannot clearly recognize the contents on liquid crystal display panel $30_3$ in display unit $30_2'$. In this copying machine, when a power switch is turned on, main processor group 71 is set in the angle setting mode of unit $30_2'$. In this mode, group 71 performs operations according to a flow chart in FIG. 27.

Figure 28:
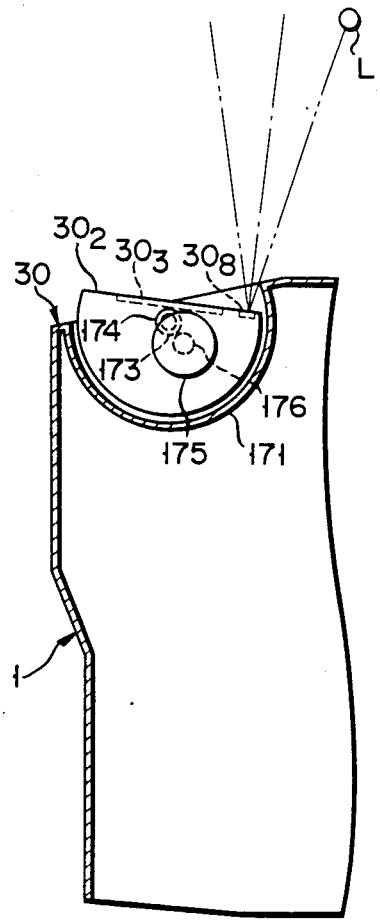

In step ST21, main processor group 71 in FIG. 6 drives stepping motor 175 through motor driver 80 to pivot display unit $30_2'$ in one of directions of arrows e and f, and light source L located near housing 1 is detected by photosensor $30_8$. As shown in FIG. 28A, when light source L is detected by photosensor $30_8$ (FIG. 6), the position of light source L is detected by, e.g., the number of drive pulses of motor 175 in step ST22. The setting angle of unit $30_2$ is calculated according to the positions of light source L and eye E of the operator such that reflected light of light source L is not incident on eye E and the surface of liquid crystal display panel $30_3$ is perpendicular to a direction toward the operator's eyes. In step ST23, stepping motor 175 is driven on the basis of the set position. Therefore, unit $30_2$ is pivoted such that light from light source L is not directly incident on eye E and the surface of liquid crystal display panel $30_3$ is perpendicular to a direction toward the operator's eyes, as shown in FIG. 28B.

According to the second embodiment, display unit $30_2'$ is pivoted by stepping motor 175 to cause photosensor sensor $30_8$ arranged in unit $30_2'$ to detect light source L located near housing 1. A target position for unit $30_2'$ is calculated by the detected position of light source such that light from source L is not directly incident on eyes of the operator and that the surface of liquid crystal display panel $30_3$ is perpendicular to a direction toward the operator's eyes. Unit $30_2'$ is pivoted to this position. Therefore, panel $30_3$ can be pivoted to a position where the operator can easily recognize the displayed contents. This display unit can be thus conveniently used in practice.

Since this arrangement is simple, it can provide economical advantages.

Furthermore, since display unit $30_2'$ is coupled to stepping motor 175 through gears 174 and 176, gears 174 and 176 and motor 175 serve as loads for display unit $30_2'$. Therefore, even if motor 175 is de-energized, unit $30_2'$ is not easily pivoted, and liquid crystal display panel $30_3$ can be firmly held in position.

Display unit $30_2'$ may be held in the set position by energizing stepping motor 175.

The angle setting operation of display unit $30_2'$ is not limited at the time of system energization.

Various other changes and modifications may be made within the spirit and scope of the invention.

What is claimed is:

1. An image forming apparatus with a color change area discriminating function, said apparatus comprising:

an original table on which a light-transmitting original is placed;

transmission light emitting means, provided movable along said original table, for emitting transmission light through the original placed on said original table;

color change area designating means for shifting the light emitted from said transmission light emitting means to an arbitrary area of an original image which is to be subjected to a change in color of image formation to designate the arbitrary area as a portion to be subjected to a change in color of image formation prior to an image formation operation;

color change area storage means for storing first position data representing the area to be subjected to a change in color of image formation and second position data representing a remaining area excluding the area to be subjected to a change in color of image formation, in response to designation by said color change area designating means;

original scanning means, arranged to optically scan the original placed on said original table, for producing an optical image of the original upon completion of scanning of the original;

image forming means for focusing the optical image of the original which is scanned by said original scanning means and selectively driving first and second developing units respectively containing first and second color agents corresponding to at least basic and change colors, thereby forming an image on an image forming medium with predetermined colors;

image erasing means arranged to selectively erase an image to be formed by said image forming means;

image forming medium returning means arranged to selectively return the image forming medium with the image formed by said image forming means to said image forming means;

color change area display means, having a display element capable of displaying a pattern, for flashing a display pattern corresponding to the area to be subjected to a change in color of image formation and designated by said change color area designating means, the display pattern being included in a display pattern corresponding to the original;

first control means for supplying a drive signal to said first developing unit in said image forming means during first image formation operation, reading out from said color change area storage means the first position data representing the area to be subjected to a change in color of image formation and supplying the readout data as an erasure signal to said image erasing means, and supplying a return instruction signal to said image forming medium returning means; and second control means for supplying a drive signal to said second developing unit in said image forming means during second image formation operation, reading out from said color change area storage means the second position data representing the area excluding the area to be subjected to a change in color of image formation, and supplying the readout data as an erasure signal to said image erasing means.

2. An apparatus according to claim 1, wherein said color change area display means performs a flashing display of a checkered pattern.

3. An apparatus according to claim 1, wherein said color change area display means performs flashing display of a character pattern representing the change in color of image formation.

4. An apparatus according to claim 3, wherein said color change area display means performs normal display of a character pattern representing the change in color of image formation.

5. An apparatus according to claim 1, wherein said color change area display means comprises a liquid crystal display unit of a dot matrix type.

6. An apparatus according to claim 5, wherein said liquid crystal display unit is arranged such that a major display surface is pivotal.

7. An apparatus according to claim 6, further comprising:

light source detecting means, arranged near said liquid crystal display unit, for detecting a position of an external light source;

rotating means for pivoting said liquid crystal display unit; and rotation control means for receiving a detection result from said light source detecting means and biasing said rotating means to rotate said major display surface of said liquid crystal display unit to a predetermined position.

* * * * *